US007080749B2

(12) United States Patent
Van Bruggen

(10) Patent No.: US 7,080,749 B2
(45) Date of Patent: Jul. 25, 2006

(54) DRUM CLOSURE OVERCAP AND COMBINATION

(76) Inventor: Bert Van Bruggen, American Flange, Carol Stream, IL (US) 60188

( * ) Notice: Subject to any disclaimer, the term of this patent is extended or adjusted under 35 U.S.C. 154(b) by 197 days.

(21) Appl. No.: 10/729,324

(22) Filed: Dec. 8, 2003

(65) Prior Publication Data

US 2005/0121451 A1 Jun. 9, 2005

(51) Int. Cl.
*B65D 51/20* (2006.01)
*B65D 6/40* (2006.01)
*B65D 17/34* (2006.01)

(52) U.S. Cl. ..... 220/257.2; 220/270; 220/661

(58) Field of Classification Search ..... 220/257.1, 220/257.2, 266, 270, 276, 661; 215/253–256; 222/541.9
See application file for complete search history.

(56) References Cited

U.S. PATENT DOCUMENTS

| | | | | |
|---|---|---|---|---|
| 3,858,742 | A * | 1/1975 | Grussen | 215/253 |
| 3,865,268 | A | 2/1975 | Coop | |
| 3,931,904 | A | 1/1976 | Coop | |
| 4,073,399 | A | 2/1978 | Lewis | |
| 4,227,619 | A | 10/1980 | Magnusson | |
| 4,230,229 | A * | 10/1980 | Crisci | 215/253 |
| 4,387,818 | A | 6/1983 | Conti | |
| 4,534,481 | A * | 8/1985 | Summers et al. | 215/253 |
| 5,996,833 | A | 12/1999 | Lencioni | |
| 6,116,444 | A * | 9/2000 | Bosl et al. | 215/253 |
| 6,360,908 | B1 | 3/2002 | Kline | |

* cited by examiner

*Primary Examiner*—Nathan J. Newhouse
*Assistant Examiner*—James Smalley

(57) ABSTRACT

An integrally molded all plastic drum closure overcap for application over a primary dispensing closure consisting of a snap-on cap surrounded by a frangibly connected tamper detecting band. The band is joined to a tear strip formed in the cap so as to enable destructive removal of the cap from the closure using the tamper detecting band as a ring pull member.

10 Claims, 2 Drawing Sheets

Fig.3
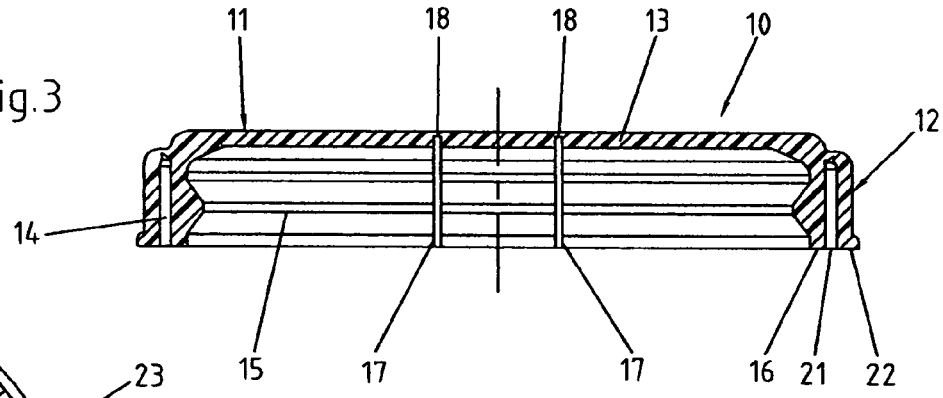
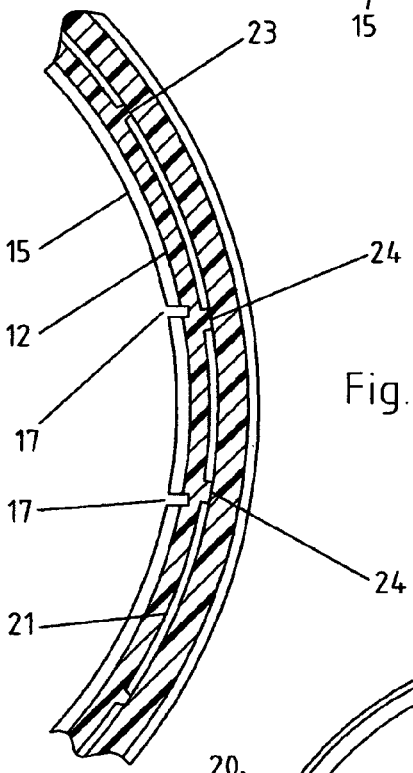
Fig.4
Fig.5
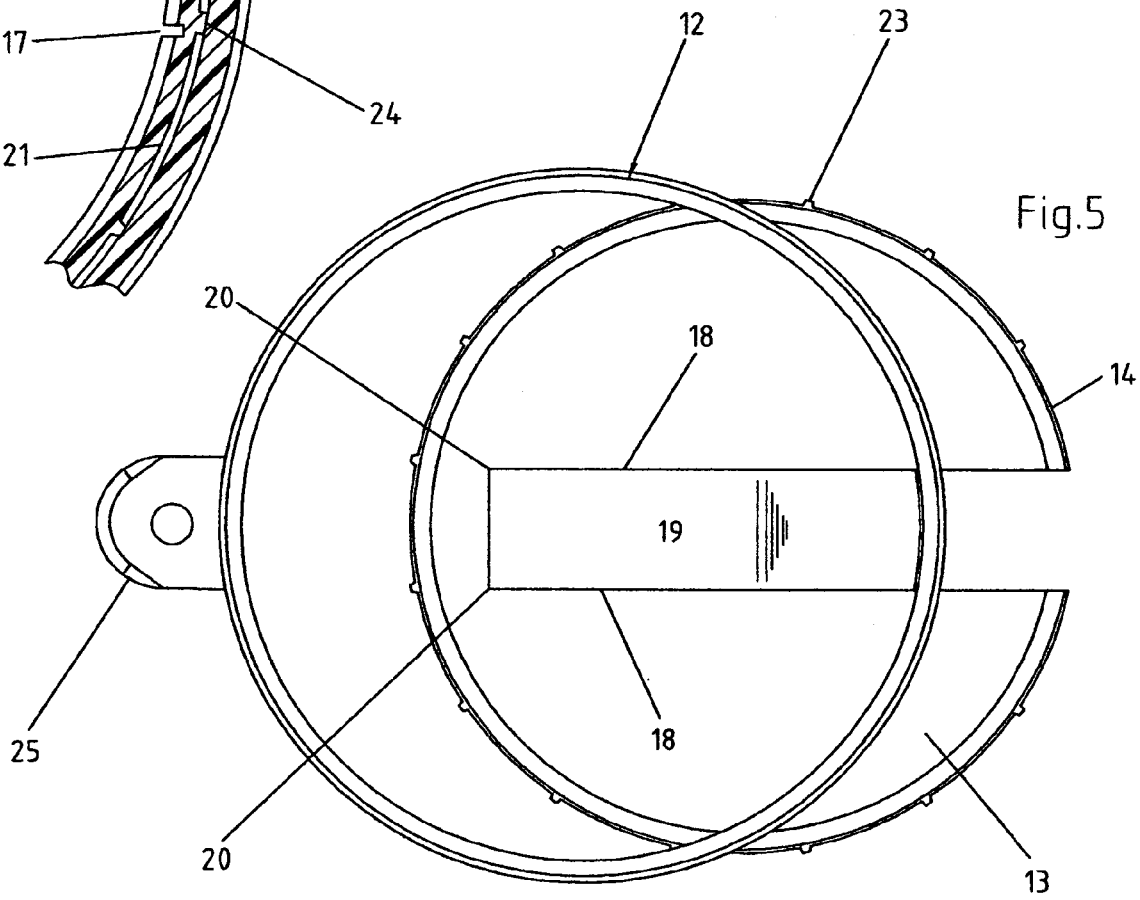

DRUM CLOSURE OVERCAP AND COMBINATION

BACKGROUND OF THE INVENTION

This invention is directed to a protective overcap commonly applied over a primary drum dispensing closure.

In the drum industry it has long been the common practice to equip filled and closed drums with a protective overcap applied over the primary dispensing closure. Heretofore such protective overcaps made of metal or a combination of metal and plastic, were crimped onto the upstanding neck surrounding the threaded dispensing opening. While these crimped on drum seals performed satisfactorily for their intended function, they had certain shortcomings when viewed in the light of present day market conditions. For example, these crimped on seals were applied with either a manual or power operated crimping tool specially designed for that purpose. These tools are relatively costly and rather cumbersome to use under continuous production conditions. The current trend is clearly toward ease of application taking advantage of any possible cost savings in terms of labor and equipment.

In addition, crimped on seals without exception are either formed entirely of metal or incorporate a metal collar of some sort to support the crimping action. This metal presence necessitates some form of metal cutting or tearing action to enable authorized removal of the seal from the underlying closure. Regardless of the degree of care exercised in the removal operation, the possibility of misstep is always present. Any cut finger hazard, real or perceived, is in today's world looked upon as a significant negative. Thus both safety of removal and ease of removal are now very much sought after.

As a consequence a number of all plastic overcaps adapted for application to drum closures have recently been brought forward. Each of these has to date, however, exhibited one deficiency or another when used under actual field conditions. The need for ease of application of an all plastic closure overcap requires sufficient flexibility to enable unassisted, single-handed seating of the overcap on the closure neck protruding from the top of a 55 gallon drum. This seemingly minor operation has a significant effect on drum filling efficiency. At the same time subsequent authorized removal of the overcap must be achievable with relative ease, unaided without the use of any tool, knife or the like. In addition, such authorized removal must effect some obvious destruction of the overcap construction or a part thereof in order to thwart any spurious reapplication of the part. Any undetectable tampering or pilferage is thus averted.

BRIEF SUMMARY OF THE INVENTION

The invention seeks to overcome these and other prior art deficiencies in disclosing an all plastic drum closure overcap designed for easy manual application to the upstanding closure neck of a shipping and storage drum. Minimum, single handed, straight downward force snaps the overcap firmly in place. Once securely seated over the primary drum dispensing closure, undetectable tampering by any reasonable means is substantially precluded. Authorized removal is very quick and easy with a minimal amount of effort. And in so doing the overcap is essentially broken so as to prevent any unwanted, deceptive reapplication that normal scrutiny would overlook.

All of this is accomplished by the provision of an integrally molded snap-on cap surrounded by an annular tamper detecting band which also serves as a removal aid. The snap-on cap has a top wall bordered by a depending skirt. A pair of score lines extend across the cap skirt and into the cap top defining a tear strip therebetween. The tamper detecting band is circumferentially enlarged to surround the snap-on cap skirt and is connected thereto by a series of spaced apart frangible connecting webs. In one area the tamper detecting band is joined to the snap-on cap at either side of the tear strip portion disposed in the cap skirt. The tamper detecting band is further provided with a radially projecting gripping ear positioned diametrically opposite the tear strip juncture to assist authorized breakaway of the band from the snap-on cap. The tamper detecting band then becomes a hand gripable ring pull to enable destructive tear off removal of the snap-on cap from the drum opening neck exposing the primary closure for valid decanting. From the foregoing it can be easily seen that this improved "easy on, easy off" tamper evident drum closure overcap is readily distinguishable from the heretofore presented prior art constructions.

It is accordingly a principal object of the invention to provide a new and improved all plastic tamper evident drum closure overcap.

A further object is to provide an improved all plastic easy on, easy off user friendly overcap for use on industrial container closures.

A still further object is to provide an improved tamper evident drum closure overcap incorporating a dual function tamper detecting ring pull handgrip for removal.

Other and more detailed objects will in part be obvious and in part pointed out as the description of the invention taken in conjunction with the accompanying drawing proceeds.

In that drawing:

FIG. 3 is a vertical cross sectional view taken along lines 3—3 in FIG. 2 and looking in the direction of the arrows;

FIG. 4 is a an enlarged fragmentary sectional view of the cap and band connection; and FIG. 5 is a top plan view of a destroyed drum closure overcap after removal.

DETAILED DESCRIPTION OF THE PREFERRED EMBODIMENT

Figure 1:
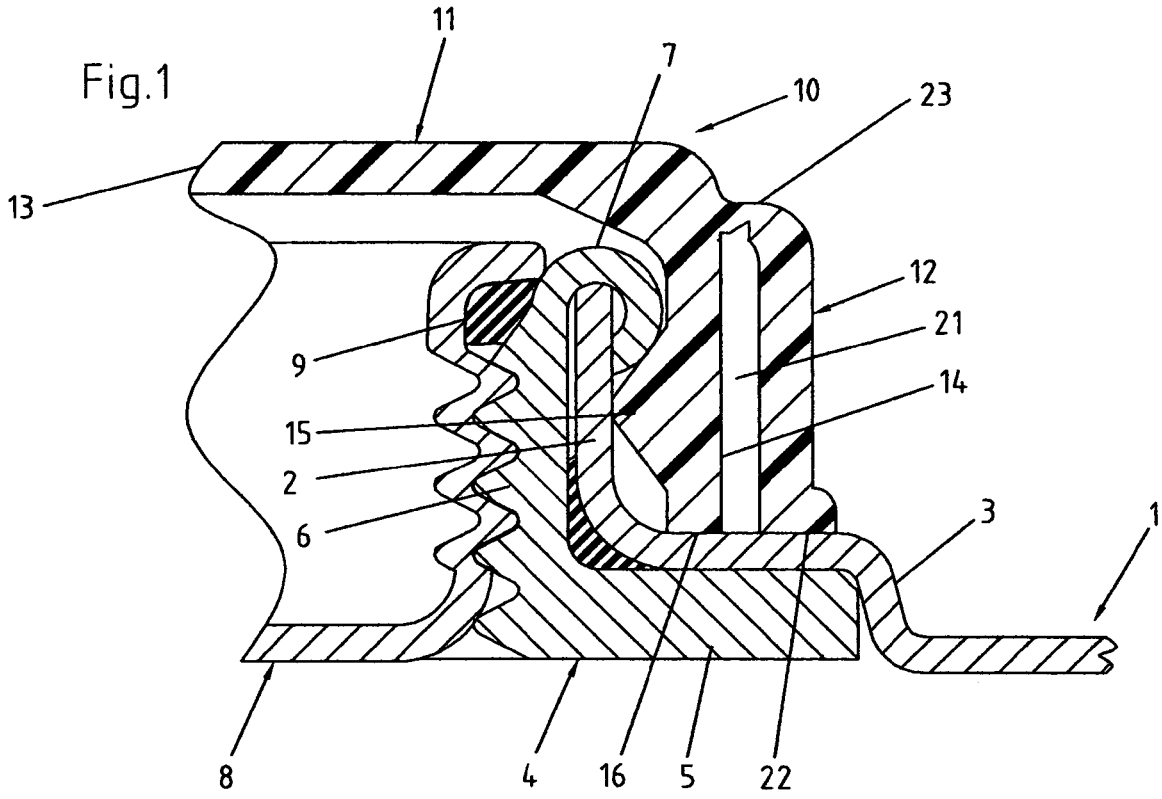
FIG. 1 is an enlarged fragmentary sectional view of the drum closure overcap seated on a drum closure in accordance with the invention.

A container wall such as part of a steel drum or other industrial size container is shown in FIG. 3 at numeral 1 formed with an upstanding neck 2 surrounded by a raised polygonal embossment 3. A closure flange 4 is inserted within the container wall 1 having a polygonal base 5 underlying the embossment 3 and an internally threaded cylindrical body 6 fitted within the neck 2. The upper end portion of the flange body 6 is formed outwardly over the uppermost end of the container wall neck in a circumferentially enlarged curl 7. A closure plug 8 is threadedly engaged in the flange 4 and has a gasket 9 which engages the inner surface of the flange curl 7 so as to seal off the drum dispensing opening.

Figure 2:
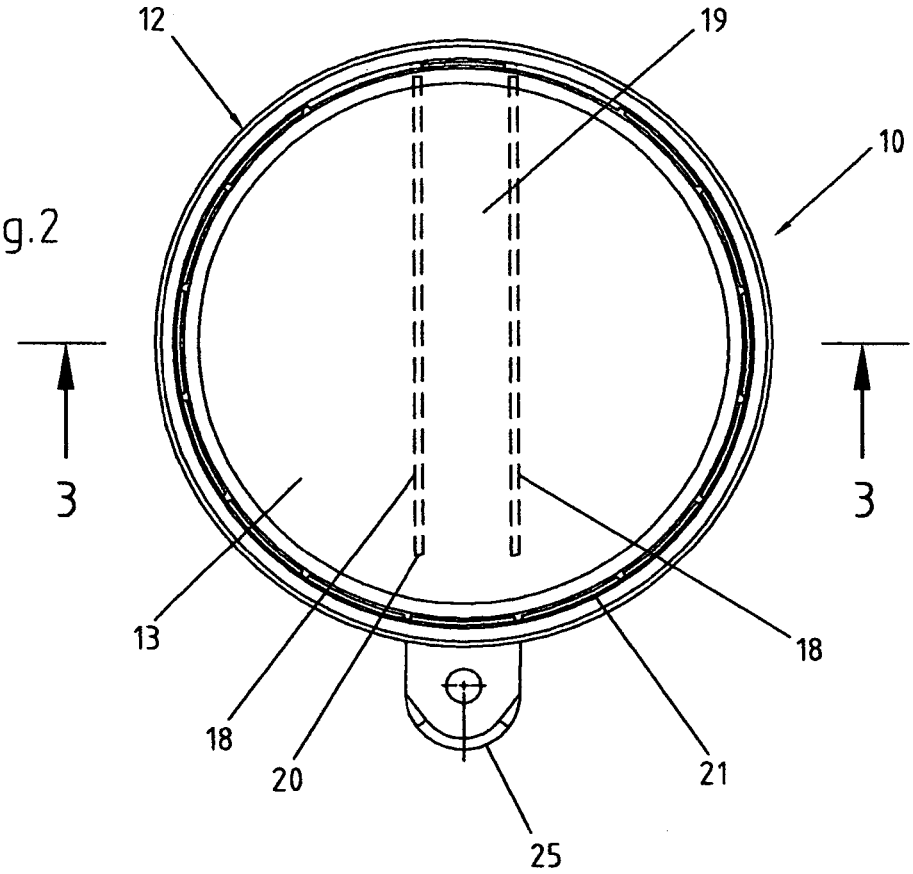
FIG. 2 is a top plan view of the drum closure overcap.

The drum closure overcap 10 as shown in FIG. 1 is integrally molded of a plastic synthetic resin such as polyethylene and is made up of an inner snap-on cap 11 and an outer tamper detecting band 12. The snap-on cap has a disc like top wall 13 surrounded by a depending skirt 14. The skirt has an annular locking bead 15 protruding from the inner surface thereof and terminates in a lowermost free edge 16. The snap-on cap 11 is further provided with a pair of internal score lines which could also be external extending upwardly across the skirt 14 as shown at 17 in FIG. 3 and extending across the top wall at 18 as seen in FIG. 2. The score lines 17 an 18 form a tear strip 19 therebetween starting at the snap-on cap skirt free edge 16 and terminating at a point 20 in the top wall 13.

The tamper detecting band 12 is circumferentially enlarged relative to the snap-on cap skirt 14 creating a narrow space 21 therebetween and also terminates in a lowermost free edge 22. The upper edge of the tamper detecting band 12 is radiused inwardly and connected to the snap-on cap skirt 14 by a series of frangible connecting webs 23. In FIG. 4 it can be seen that the webs 23 are wider at their connection to the skirt 14 and narrower at their connection to the band 12. As seen in FIG. 2 the frangible webs 23 are equally spaced about the circumference of the snap-on cap skirt 14 except in the area of the skirt score lines 17. In this area, as seen in FIG. 4, the tamper detecting band 12 is joined to the skirt 14 by a pair of axially extending ribs 24. Diametrically opposite the ribs 24 and score lines 17 is a radially protruding gripping ear 25 integrally connected to the lower end of the band 12.

Turning back to FIG. 1 it can be seen how the overcap 10 is snapped onto the drum closure with the snap-on cap locking bead 15 engaged beneath the flange curl 7 and tightly against the drumstock neck 2. In reaching this position the annular gap 21 between the snap-on cap skirt 14 and the tamper detecting band 12 allows the necessary expansion of the skirt without stressing the band and possibly inadvertently breaking some of the frangible connecting webs 23. Also in the fully seated applied position it can be seen that both the free edge 16 of the skirt 14 and the free edge 19 of the band 12 rest in contact with the drumstock embossment 3. This relationship prevents access by a knife or like tool to attempt pry off for the purpose of pilfering. Should such access be attempted, however, getting under the band 12 and prying off the skirt 14 would most certainly rupture the frangible connecting webs 23 giving clear indication tampering may have occurred.

For authorized removal one would simply grasp the ear 25 and lift the tamper detecting band rupturing the connecting webs 23. Here it should be noted that the webs, due to their construction, break away from the band leaving the band interior smooth and the torn vestiges on the snap-on cap skirt. The band 12 then serves as a convenient pull ring allowing ample tearing force to separate the tear strip 19 along the score lines 17 and 18 as shown in FIG. 5. Upon reaching the termination point 20 of the score lines 18, the tearing force is easily sufficient to dislodge the torn cap from the flange curl 7. It thus becomes apparent that the drum closure overcap herein disclosed can be easily manually snapped onto an upstanding drum closure neck without the aid of any applying mechanism. Once seated on the drum closure a substantial degree of security is added to the container in that removal is in any fashion results in rupturing the frangible breakaway webs making such removal or attempt thereof easily detected. Removal in an authorized manner causing complete destruction of the snap-on cap is also accomplished with minimum effort due to the two step opening movement using the tamper detecting band as a handgrip.

Various other changes in or modifications to the drum closure overcap and combination would suggest themselves to those skilled in the art and could be made without departing from the spirit and scope of the invention. For example, different plastic resins could be used to mold the overcap. It is accordingly intended that all matter contained in the above description or shown in the accompanying drawing shall be interpreted as being illustrative and not in a limiting sense.

I claim:

1. A drum closure overcap for application over a primary dispensing closure on industrial size containers comprising an integrally molded plastic cap having a disc like top wall surrounded by a depending skirt terminating in a first free edge, an annular locking bead formed on the interior of said cap skirt, a circumferentially enlarged tamper detecting band surrounding a major exterior surface portion of the height of said cap skirt terminating in a second lowermost free edge, said band radially spaced from said skirt and connected thereto at spaced intervals by radially extending frangible connecting webs, a tear strip formed in said cap defined by a pair of weakened score lines extending upwardly across said cap skirt and laterally into said top wall, said tamper detecting band in one area integrally connected to said cap skirt adjacent the skirt end of said tear strip and radially protruding gripping means on said band disposed diametrically opposite said tear strip to enable separation of said frangible connecting webs so that the band can be subsequently grasped for destructive removal of said cap by tearing said strip along said score lines across said skirt and into said top wall and said score lines in said top wall terminating spaced from said gripping means.

2. A drum closure overcap as in claim 1 and said frangible connecting webs interrupted in the area of said band connection.

3. A drum closure overcap as in claim 1 and said connecting webs configured to rupture adjacent said band leaving the torn vestige on said skirt.

4. A drum closure overcap as in claim 1 and said connection between said skirt and said band extending axially away from said first free edge.

5. A drum closure overcap as in claim 1 wherein said first and second free edges are substantially coplanar.

6. In combination, a manually applied overcap and a container dispensing closure comprising a laterally extending container wall, an internally threaded upstanding neck formed in said wall, said neck terminating in a circumferentially enlarged outward curl, an integrally molded plastic cap fitted on said neck, said cap having a disc like top wall surrounded by a depending skirt terminating in a first free edge lying in close surface to surface proximity to said container wall, an annular locking bead formed on the interior of said cap skirt in engagement with said neck curl, a circumferentially enlarged tamper detecting band surrounding a major exterior surface portion of the height of said cap skirt terminating in a second lowermost free edge, frangible interconnecting means between said band and skirt, a tear strip formed in said cap extending upwardly across said cap skirt and laterally into said top, said band integrally connected to said tear strip and said tamper detecting band including gripping means to enable separation of said band so the band can be grasped for destructive removal of said cap from container neck by tearing said strip along said score lines out of said cap and exposing said dispensing closure.

7. The combination as in claim 6 wherein said first and second free edges are substantially coplanar.

8. The combination as in claim 6 and said skirt free edge lying in direct contact with said container wall.

9. In combination, a manually applied overcap and a container dispensing closure comprising a container wall, an internally threaded upstanding neck formed in said wall, said neck terminating in a circumferential enlargement, an integrally molded plastic cap fitted on said neck, said cap having a disc like top wall surrounded by a depending skirt terminating in a first free edge lying in close proximity to said upstanding neck, internal closure locking means formed on said overcap, a circumferentially enlarged tamper detecting band surrounding a major exterior portion of the height of said cap skirt terminating in a second lowermost free edge, a series of frangible interconnecting webs between said band and skirt, a tear strip formed in said cap defined by a pair of weakened score lines extending upwardly across said cap skirt and laterally at least partially across said cap top, said tamper detecting band in one area integrally connected to said cap skirt adjacent the skirt end of said tear strip and circumferentially narrow finger gripping means protruding radially from said band to enable separation of said band from said skirt by rupturing said interconnecting webs so the band can be hand grasped for destructive removal of said cap from said container neck by tearing said strip along said score lines across said skirt and into said top wall exposing said dispensing closure.

10. The combination as in claim 9 and said score lines extending across a major portion of said cap top.

* * * * *

UNITED STATES PATENT AND TRADEMARK OFFICE

CERTIFICATE OF CORRECTION

PATENT NO. : 7,080,749 C1
APPLICATION NO. : 90/008451
DATED : July 1, 2008
INVENTOR(S) : Van Bruggen It is certified that error appears in the above-identified patent and that said Letters Patent is hereby corrected as shown below:

Print Amended Figure 4, shown below, which was amended to by adding reference numeral 14 and changing the element referenced by reference numeral 12. The amendment to Figure 4 was approved for entry by the examiner prior to the issuance of the Reexamination Certificate.

UNITED STATES PATENT AND TRADEMARK OFFICE

CERTIFICATE OF CORRECTION

PATENT NO. : 7,080,749 C1
APPLICATION NO. : 90/008451
DATED : July 1, 2008
INVENTOR(S) : Van Bruggen It is certified that error appears in the above-identified patent and that said Letters Patent is hereby corrected as shown below:

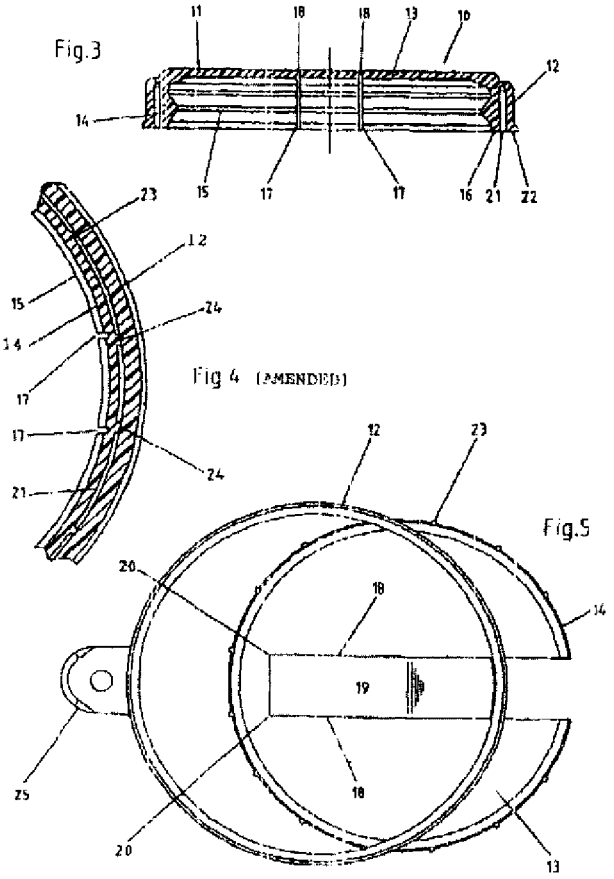

Signed and Sealed this

Twenty-third Day of September, 2008

JON W. DUDAS
*Director of the United States Patent and Trademark Office*

US007080749C1

(12) EX PARTE REEXAMINATION CERTIFICATE (6281st)

United States Patent

Van Bruggen

(10) Number: US 7,080,749 C1

(45) Certificate Issued: Jul. 1, 2008

(54) DRUM CLOSURE OVERCAP AND COMBINATION

(75) Inventor: Bert Van Bruggen, Carol Stream, IL (US)

(73) Assignee: American Flange & Msg. Co., Inc., Carol Stream, IL (US)

Reexamination Request:
No. 90/008,451, Mar. 8, 2007

Reexamination Certificate for:

| | |
|---|---|
| Patent No.: | **7,080,749** |
| Issued: | **Jul. 25, 2006** |
| Appl. No.: | **10/729,324** |
| Filed: | **Dec. 8, 2003** |

(51) Int. Cl.

| | |
|---|---|
| ***B65D 51/20*** | (2006.01) |
| ***B65D 17/34*** | (2006.01) |
| ***B65D 6/40*** | (2006.01) |

(52) U.S. Cl. ..... 220/257.2; 220/270; 220/661

(58) Field of Classification Search ..... None
See application file for complete search history.

(56) References Cited

U.S. PATENT DOCUMENTS

| | | | | |
|---|---|---|---|---|
| 2,760,671 | A | 8/1956 | Parish, Jr. | 220/7 |
| 4,209,101 | A | 6/1980 | Brown | |
| 4,227,619 | A | 10/1980 | Magnusson | 215/255 |
| 4,230,229 | A | 10/1980 | Crisci | 215/253 |
| 5,833,098 | A * | 11/1998 | Gomi | 222/400.7 |
| 6,360,908 | B1 | 3/2002 | Kline | 220/257 |
| 6,726,048 | B2 | 4/2004 | Dwinell et al. | 220/257.2 |

FOREIGN PATENT DOCUMENTS

| | | |
|---|---|---|
| DE | 297 02 142 U1 | 7/1997 |
| EP | 0 725 013 A1 | 8/1996 |

* cited by examiner

*Primary Examiner*—Jeanne M. Clark

(57) ABSTRACT

An integrally molded all plastic drum closure overcap for application over a primary dispensing closure consisting of a snap-on cap surrounded by a frangibly connected tamper detecting band. The band is joined to a tear strip formed in the cap so as to enable destructive removal of the cap from the closure using the tamper detecting band as a ring pull member.

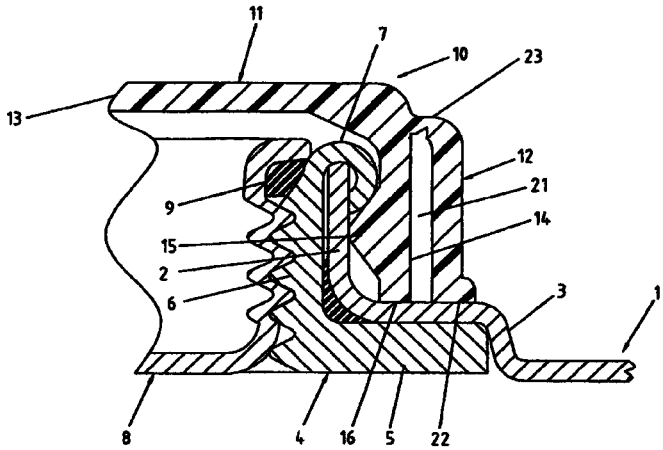

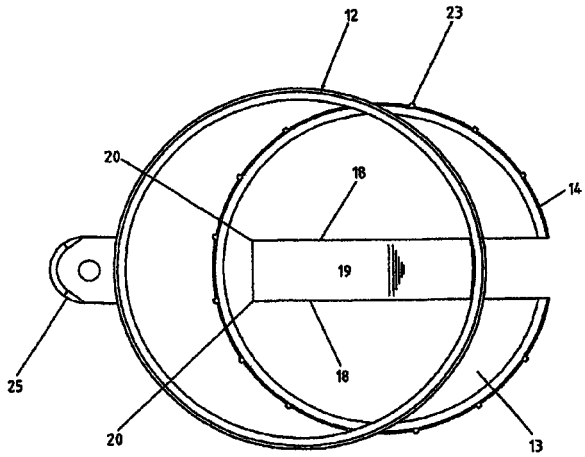

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

claims 1–3, 6, 9 and 10 are determined to be patentable as amended.

Claims 4, 5, 7 and 8, dependent on an amended claim, are determined to be patentable.

1. A drum closure overcap for application over a primary dispensing closure on industrial size containers comprising*:* an integrally molded plastic cap having a disc like top wall surrounded by a depending *cap* skirt terminating in a first *lowermost* free edge, an annular locking bead formed on the interior of said cap skirt, a circumferentially enlarged tamper detecting band *having a radially inner surface* surrounding a major exterior surface portion of [the] *a* height of said cap skirt terminating in a second lowermost free edge, said band radially spaced from said skirt and connected thereto at spaced intervals by radially extending frangible connecting webs, a tear strip formed in said cap defined by a pair of weakened score lines extending upwardly across said cap skirt and laterally into said top wall, said tamper detecting band in one area [integrally connected] *having an integral connection* to said cap skirt [adjacent the] *by at least one axially extending rib along a portion of the height of said cap skirt between the radially inner surface of said tamper detecting band and said cap skirt on a* skirt end of said tear strip*;* and

*a* radially protruding gripping means on said band disposed diametrically opposite said [tear strip] *integral connection between the band and cap skirt* to enable [separation of] *destructive removal of said cap by lifting the band by grasping the gripping means to separate* said frangible connecting webs [so that the band can be subsequently grasped for destructive removal of said cap by tearing] *and subsequently grasping and pulling on said band to tear* said *tear* strip along said score lines across said *cap* skirt and into said top wall*;* and said score lines in said top wall terminating spaced from said gripping means.

2. A drum closure overcap as in claim 1 and said frangible connecting webs interrupted in the area of said [band] *integral* connection *between the band and said cap skirt*.

3. A drum closure overcap as in claim 1 and said connecting webs configured to rupture adjacent said band leaving [the] *a* torn vestige *of said connecting webs* on said skirt.

6. In combination, a manually applied overcap and a container dispensing closure comprising*:* a laterally extending conatiner wall, an internally threaded upstanding neck formed in said wall, said neck terminating in a circumferentially enlarged outward curl, an integrally molded plastic cap fitted on said neck, said cap having a disc like top wall surrounded by a depending *cap* skirt terminating in a first *lowermost* free edge lying in close surface to surface proximity to said container wall, an annular locking bead formed on the interior of said cap skirt in engagement with said neck curl, a circumferentially enlarged tamper detecting band *having a radially inner surface* surrounding a major exterior surface portion of [the] *a* height of said cap skirt *and* terminating in a second lowermost free edge, frangible interconnecting means between said band and skirt, a tear strip formed in said cap extending upwardly across said cap skirt and laterally into said top *wall*, said *tamper detecting* band [integrally connected] *having an integral connection* to said tear strip *by at least one axially extending rib along a portion of the height of said cap skirt between the radially inner surface of said tamper detecting band and said cap skirt on a skirt end of said tear strip* and said tamper detecting band including *radially protruding* gripping means to enable separation of said band *from said cap skirt by lifting the band* so the band can be *subsequently* grasped for destructive removal of said cap from *said* container neck by tearing said *tear* strip along said score lines out of said cap *skirt and top wall* and exposing said dispensing closure.

9. In combination, a manually applied overcap and a container dispensing closure comprising*:* a container wall, an internally threaded upstanding neck formed in said wall, said neck terminating in a circumferential enlargement, an integrally molded plastic cap fitted on said neck, said cap having a disc like top wall surrounded by a depending *cap* skirt terminating in a first *lowermost* free edge lying in close proximity to said upstanding neck, internal closure locking means formed on said overcap, a circumferentially enlarged tamper detecting band *having a radially inner surface* surrounding a major exterior portion of [the] *a* height of said cap skirt terminating in a second lowermost free edge, a series of frangible interconnecting webs between said band and skirt, a tear strip formed in said cap defined by a pair of weakened score lines extending upwardly across said cap skirt and laterally at least partially across said cap top *wall*, said tamper detecting band in one area [integrally connected] *having an integral connection* to said cap skirt [adjacent the] *by at least one axially extending rib along a portion of the height of said cap skirt between the radially inner surface of said tamper detecting band and said cap skirt on a* skirt end of said tear strip and circumferentially narrow finger gripping means protruding radially from said band to enable separation of said band from said skirt by rupturing said interconnecting webs *by lifting the band by grasping the gripping means* so the band can be *subsequently* hand grasped for destructive removal of said cap from said container neck by tearing said *tear* strip along said score lines across said skirt and into said top wall exposing said dispensing closure.

10. The combination as in claim 9 and said score lines ectending across a major portion of said cap top *wall*.

* * * * *